United States Patent [19]

Fredrickson

[11] Patent Number: 4,639,562

[45] Date of Patent: Jan. 27, 1987

[54] KEY LOCK SWITCH WITH ANTISTATIC MEANS

[75] Inventor: Eric Fredrickson, W. Bridgewater, Mass.

[73] Assignee: C&K Components, Inc., Newton, Mass.

[21] Appl. No.: 671,409

[22] Filed: Nov. 14, 1984

[51] Int. Cl.[4] ..... H01H 27/06

[52] U.S. Cl. ..... 200/43.08; 200/305; 200/11 R; 200/277

[58] Field of Search ..... 200/304, 305, 44, 277, 200/275, 306, 8 R, 8 A, 11 R, 11 J, 11 A, 155 R, 42 R, 43.04, 43.06, 43.08

[56] References Cited

U.S. PATENT DOCUMENTS

| | | | |
|---|---|---|---|
| 3,184,559 | 5/1965 | Oxley | 200/11 R |
| 3,941,954 | 3/1976 | Wintringham | 200/44 |
| 4,009,357 | 2/1977 | Naylor | 200/42 R |
| 4,405,843 | 9/1983 | Wolniak et al. | 200/44 |
| 4,427,852 | 1/1984 | Wolniak et al. | 200/44 |
| 4,527,024 | 7/1985 | Lai | 200/43.08 X |

FOREIGN PATENT DOCUMENTS

| | | | |
|---|---|---|---|
| 0066826 | 12/1982 | European Pat. Off. | 200/43.08 |
| 1488412 | 5/1973 | Fed. Rep. of Germany | 200/43.08 |
| 80168 | 2/1963 | France | 200/43.08 |

*Primary Examiner*—Stephen Marcus
*Assistant Examiner*—Ernest G. Cusick

[57] ABSTRACT

This invention is directed at a key lock switch having antistatic means. The antistatic means include a tubular element and a tubular antistatic wall which extends from a mid-plate and a tubular engagement portion which extends from the actuator of the switch. The antistatic wall circumscribes the tubular element in spaced relation. When the mid-plate is engaged to the actuator the tubular engagement portion is positioned between and in spaced relation to the antistatic wall and the tubular element.

9 Claims, 11 Drawing Figures

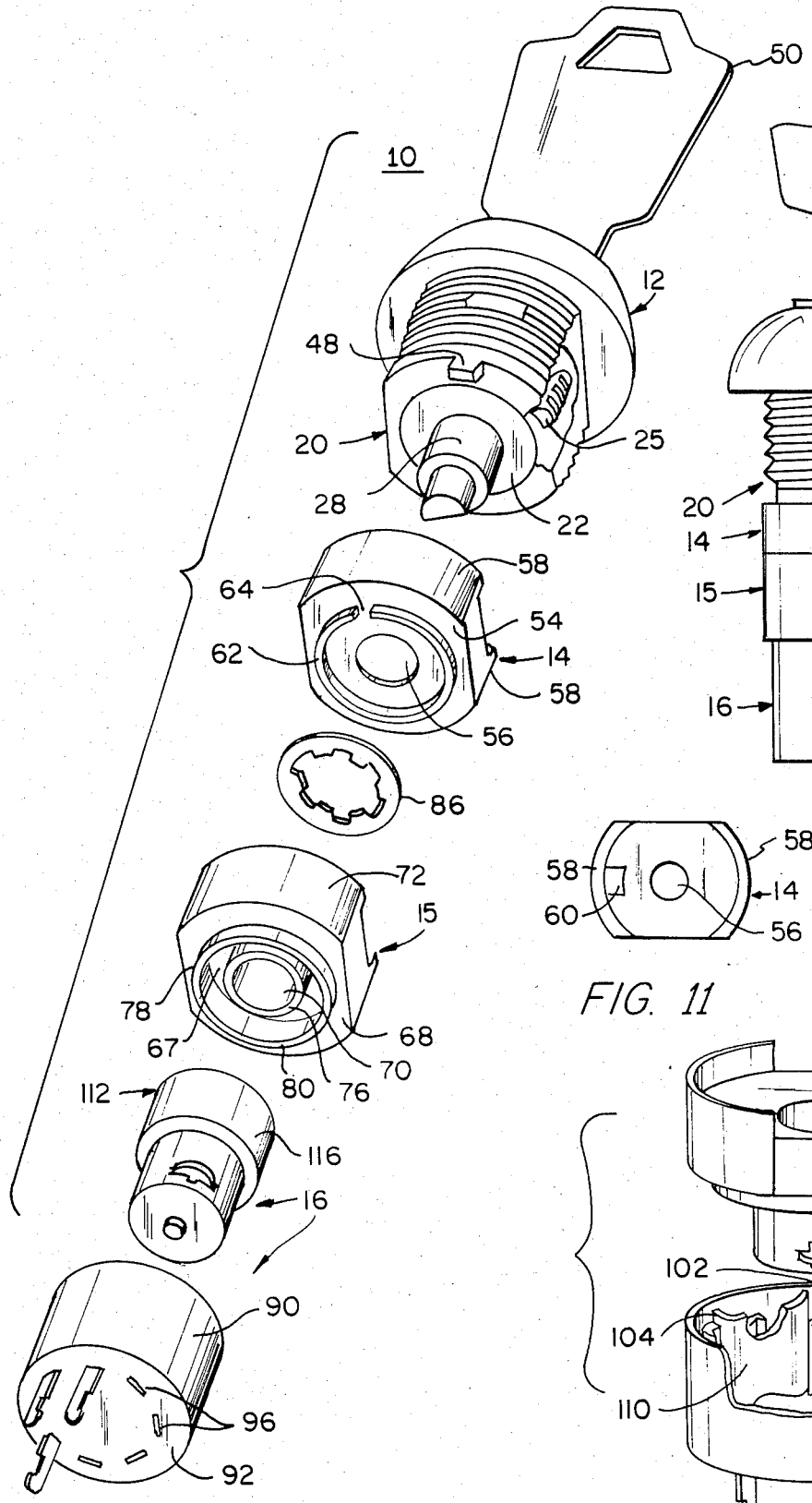
FIG. 1
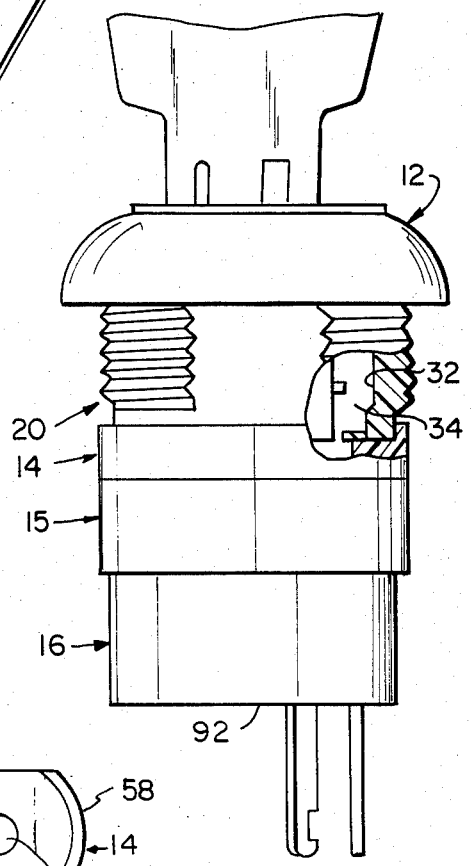
FIG. 2
FIG. 11
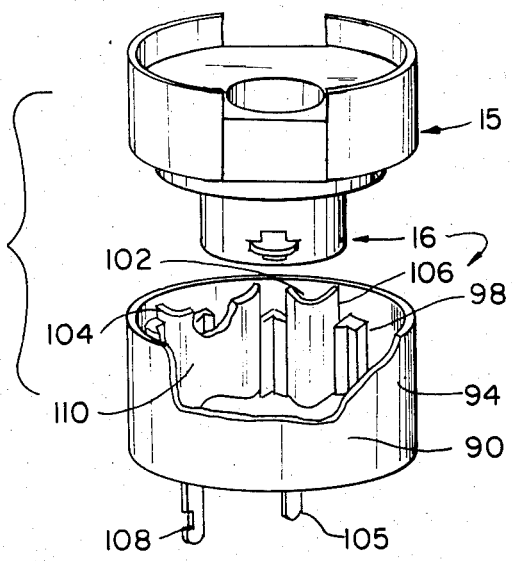
FIG. 3

KEY LOCK SWITCH WITH ANTISTATIC MEANS

BACKGROUND OF THE INVENTION

This invention relates generally to a lockable, rotary electric switch and more specifically to a tumbler type lockable electric switch for use with home television sets and the like. Switch assemblies are known in which a switch is built directly onto a cylinder lock and is used for various purposes, for example, on-off switching of electrical circuits which can only be activated by insertion of a key which fits the lock.

SUMMARY OF THE INVENTION

The invention disclosed herein comprises a switchlock for use with a cable TV system. In many cable TV systems a control box is electrically interposed between the cable TV system and the home viewing system. The system coming into the control box is scrambled and the control box needs to be activated to unscramble the system so that it can be succesfully utilized in the standard home viewing system. Some programs that are available on cable are unsuitable for viewing by childen and the use of the inventor's switchlock prevents unauthorized access to the cable system. When the inventor's lockswitch is mounted on the control box, a parent can monitor use of the cable system with the key, and if a parent does not want a child to view a program on the cable system he need only remove and retain the key. The switch lock assembly of the instant invention includes unique antistatic protection.

Generally speaking what is necessary to provide antistatic protection is a predetermined distance between two electrically charged surfaces. In the case of a lock switch, the lock portion of the assembly would pick up a static charge from a key, for example. The goal is to prevent that static charge from getting down to the switch terminals. In order to prevent the static charge from passing from the lock portion to the switch terminals and air distance between the two mentioned portions of five or six hundred thousands inches should be provided. In a conventional design the charge will pass from the farthest penetration of the metal part to the terminal since there is nothing in its way. The present invention interposes a circuitus pathway which must be travelled by the charge compressing the five or six thousands distance thereby allowing the switch assembly to be made shorter.

The contact holder is formed to provide means of setting up either a single or double pole switch.

BRIEF DESCRIPTION OF THE DRAWINGS

Further details are explained below with the help of the examples illustrated in the attached drawings in which:

FIG. 1 is an exploded view of the switch lock, with a portion of the shell broken away, according to the present invention;

FIG. 2 is a side elevational view of the switch lock, with a portion of the shell broken away, shown in FIG. 1;

FIG. 3 is an exploded, side elevational view of the switch of the switch lock shown in FIG. 1;

FIG. 11 is a top plane view of the top plate.

DESCRIPTION OF THE PREFERRED EMBODIMENT(S)

Figure 4:
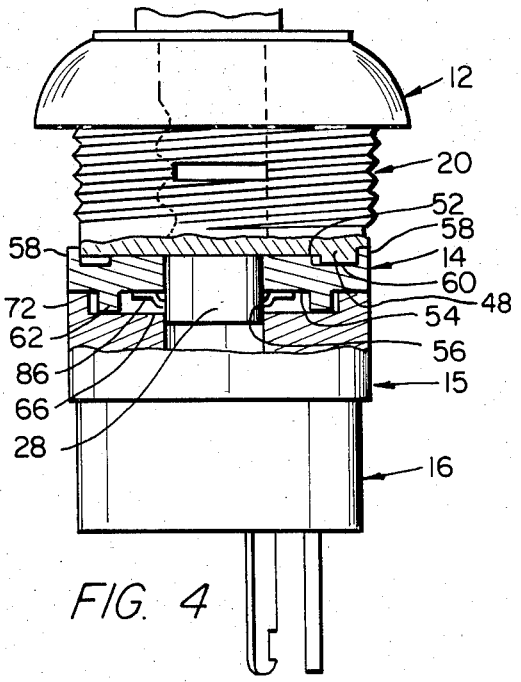
FIG. 4 is a side elevational view, with a portion broken away, showing the top plate and midplate assembled with the switch of the switch lock shown in FIG. 1.

There is shown in the drawings a switch lock 10 comprising a lock 12, a top plate 14, a mid-plate 15 and a switch 16.

The lock 12 comprises a zinc die-cast or steel activating means or lock cylinder 18 which is axially mounted in a steel or zink die-cast shell or cylinder sleeve 20. The lock cylinder 18 comprises a cylindrical body portion 22 having an annular flange 24 extending in right angle relation from adjacent one end thereof. A generally rectangular stop portion 26 extends from the body portion 22, circumscribes a section of the circumferance of the body portion 22 and is in abutting relation with the flange 24. A triangular shaped, radially moveable engagement element 25 extends from the lower external surface of the body portion 22, remote from the flange 24. An integral, cylindrical shaft 28 of less diameter than the body portion 22 extends axially from the other end of the body portion 22, remote from the flange 24. The shaft 28 is of a cylindrical external configuration and has a D-shaped free terminal end. The lock cylinder sleeve 20 has a wall 32 defining a longitudinal bore 34 within which the lock cylinder 18 with its mounted tumblers are positioned. A first land extends inwardly from the wall 32 for a portion of the internal circumferance of the bore 34. The first land is spaced below the upper end of the sleeve 20 providing a first primary circumferential surface 36. An end of the first primary circumferential surface 36 is provided with a notch defining a first shoulder 38 and a secondary first circumferential surface 40. A second land, in opposed relation to the first land, is spaced below the upper end of the sleeve 20 providing a second primary circumferential surface 42. A portion of the second circumferential surface 42 is provided with a notch defining a second shoulder 44 and secondary second circumferential surfaces 46. A series of four vertical slots 49 are formed in the wall 32. A V shaped notch 47 is formed at the bottom portion of each of the vertical slots 49. The secondary first circumferential surface 40 lies on the same horizontal plane as the secondary second circumferential surface 46. The external surface of the lock cylinder sleeve 20 is threaded and a rectangular stud 48 extends from the end of the sleeve 20 adjacent the opening through which the shaft 28 of the lock cylinder 18 extends. The cylindrical shaft 28, as setforth hereinbefore, is of a D shaped, cylindrical external configuration and has a free terminal end. The lock cylinder 18 is fitted within the bore 34 of the lock cylinder sleeve 20 with the flange 24 bearing against the first primary circumferential surface 36 and the second primary circumferential surface 42 of the lock cylinder sleeve 20, the stop portion 26 bearing against either the secondary first circumferential surface 40 or the secondary second circumferential surfaces 46 and the shaft 28 of the lock cylinder 18 extends axially beyond the area defined by the bore 34 of the lock cylinder sleeve 20. When an appropriate key 50 is engaged in the lock 12 and rotated, the lock cylinder 18 and its shaft 28 also rotate.

The top plate 14, formed of an electrically insulating material, such as a glass filled polyester plastic, comprises an upper face or surface 52, a bottom face or lower surface 54 and a centrally located through opening 56. The upper face 52 has a pair of arced guide walls 58 extending upwardly from the periphery thereof. The guide walls 58 are in spaced, opposed relationship to each other. A rectangular notch 60 is provided in the upper face 52 adjacent a guide wall 58. An engagement wall 62 extends from the lower face 54. The engagement wall 62 defines a substantially circular configuration, circumscribes the opening 56 in spaced relation, is spaced from the periphery of the lower face 54 and has a mid-plate engagement notch 64 formed therein. The top plate 14 is assembled with the lock 12 by passing the shaft 28 of the lock cylinder 18 through the opening 56 until the stud 48 of the lock cylinder sleeve 20 is seated in the notch 60. A portion of the upper face 52 bears against the lock cylinder sleeeve 20.

The mid-plate 15 is formed of an electrically insulating material, such as a glass filled polyester plastic and comprises a top surface 66, a mid-surface 67, a lower surface 68 and a centrally located through aperture 70. The top surface 66 has a support wall 72 extending upwardly therefrom. The support wall 72 defines a substantially circular configuration, spaced from the aperture 70 and is adjacent the periphery of the top surface 66. A rectangular key element 74 extends from the inner surface of the support wall 72 into the area defined thereby and toward the aperture 70. The lower surface 68 has a tubular element 76 extending therefrom which forms a continuation of the aperture 70 and is coaxial therewith. An antistatic wall 78 extends away from the lower surface 68. The antistatic wall 78 defines a substantially circular configuration, circumscribes the tubular element 76 in spaced relation, is spaced from the periphery of the lower surface 68 and has a bottom surface 80. The anti-static wall 78 extends beyond the horizontal plane of the lower surface 68. The extension of the anti-static wall 78 defines a substantially circular configuration, crrcumscribes the aperture 70 in spaced relation, is spaced from the periphery of the lower surface 68 and has an engagement notch 82 formed therein. The combination of the top plate 14 and the lock 12 is assembled with the mid-plate 15, utilizing an adhesive or by ultrasonic welding, by positioning the engagement wall 62 of the top plate 14 within the shallow cavity defined by the support wall 72 of the mid-plate 15 with key element 74 of the mid-plate 15 positioned within the mid-plate engagement notch 64 of the engagement wall 62. Prior to the assembly of the combination of the top plate 14 and the lock 12 with the mid-plate 15, the top plate 14 and the lock 12 are attached together by a retainer ring 86 which is press fitted around the terminal end of the shaft 28 to bear against the bottom face 54 of the top plate 14 within the area defined by the engagement wall 62. In this position the lock cylinder 18 and its shaft 28 with the attached retainer ring 86 may be rotated by the key 50 engaged in the lock 12. Obviously the stop portion 26 of the lock cylinder 18 can move within the recess defined by the first shoulder 38, the secondary first circumferential surface 40, the second shoulder 44 and the secondary second circumferential surfaces 46 while the top plate 14 is prevented from rotary motion by the engagement of the stud 48 with the notch 60. The arc through which the lock cylinder can rotate is controlled by the dimension of the recess defined by the first shoulder 38, the secondary first circumferential surface 40, the second shoulder 44 and the secondary second circumferential surfaces 46. This dimension can be varied to provide a switch action having a 90 degree, 180 degree etc. throw. The mid-plate 15 is then adhered to the top-plate 14 of the subassembly of the lock 12, the top-plate 14 and the retainer ring 86. Either an adhesive or welding may be utilized to complete the attachment.

Figure 5:
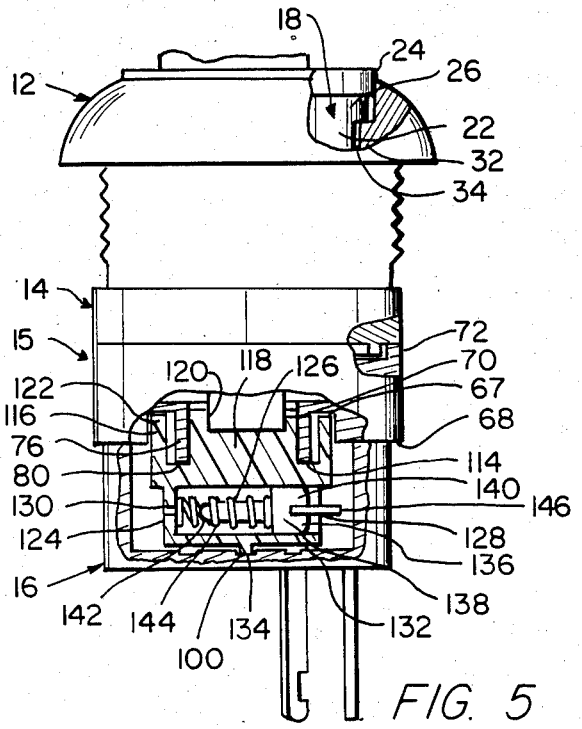
FIG. 5 is a side elevational view with a portion broken away showing the actuator assembly of the switch lock shown in FIG. 1.
Figure 6:
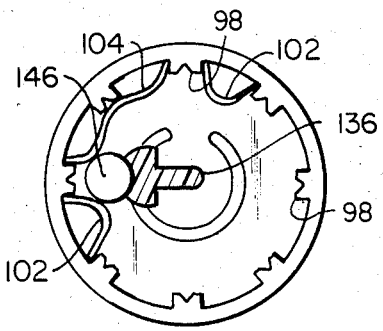
FIG. 6 is a top plan, sectional view showing contacts, contact holder and moveable contact of the switch lock shown in FIG. 1.
Figure 10:
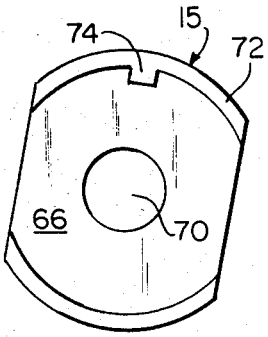
FIG. 10 is a top plan view of the midplate.
Figure 7:
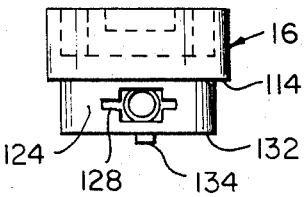
FIG. 7 is a side elevational view showing the actuator of the switch lock shown in FIG. 1.
Figure 8:
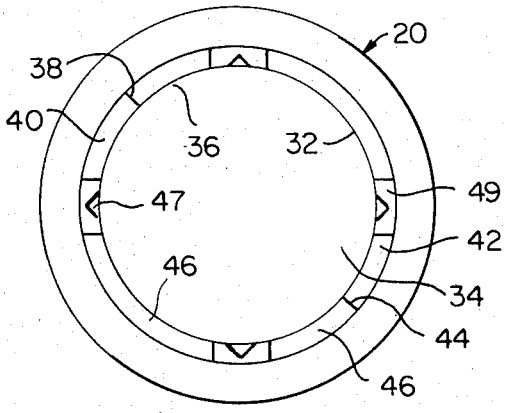
FIG. 8 is a top plan view of the shell of the switch lock shown in FIG. 1

The switch 16 has a housing 90 which may be formed of an insulating material such as bakelite, nylon, a glass filled polyester plastic or the like and comprises a circular base portion 92 having an wall 94 extending upwardly from the periphery and at right angles to the horizontal plane thereof. A series of rectangular slots 96 are formed through the base portion 92 spaced from each other and from the wall 94 defining a circular configuration. A series of spaced ribs 98 each having a V shaped notch formed in its facing surface extends upwardly from the base portion 92, integral with the wall 94 and positioned to the rear of the space between the slots 96. An axially located blind aperture 100 is centrally positioned in the base portion 92. The switch 16 includes short fixed terminals 102 and long fixed terminals 104. Each of the short fixed terminals 102 comprises a first shank portion 105 having an arced first contact portion 106 integral with a terminal end thereof and extending at right angles to the horizontal plane thereof. It should be noted that the switch 16 could have only short fixed terminals if 45 degree indexing angles were required. The use of the short and long fixed terminals provides 90 degree indexing in the embodiment described herein. Each of the long fixed terminals 104 comprises a second shank portion 108 having an arced second contact portion 110 integral with a terminal end thereof and extending at right angles to the horizontal plane thereof. The switch 16 also includes an actuator 112 which comprises an under surface 114 and an over surface 116. The over surface 116 has a tubular engagement portion 118 extending axial therefrom which includes a terminal end having a blind D shaped opening 120 formed therein and an engagement wall 122 extends away from the over surface 116. The engagement wall 122 defines a substantially circular configuration, circumscribes the tubular engagement portion 118 in spaced relation and is adjacent the periphery of the over surface 116. A tubular contact assembly engagement portion 124 extends integrally from the under surface 114. The contact assembly engagement portion 124 includes a channel 126 formed therethrough and in right angle relation to the longitudinal axis of the actuator 112. The channel 126 has a rectangular first opening 128 on one side thereof and a rectangular, comparatively narrow, slot-like second opening 130 on the opposite side thereof. The contact assembly engagement portion 124 includes an integral circular base section 132 having a first side and a second side. The first side forms a wall of the channel 126 and the second side of the base section 132 has a post portion 134 extending from the center thereof. A contact holder 136 comprising a rectangular base element 138 having a rectangular post 140 extending from the corners of one side thereof, in integral right angle relation to the horizontal plane of the base element 138 and a shaft 142 extending from the center of the other side of the base element 138, in integral right angle relation to the horizontal plane thereof. A spring 144 is engaged around the shaft 142 and the assembly of the contact holder 136 and the spring 144 is inserted into the channel 126 with the free terminal end of the shaft 142 engaged against the second opening 130 and the posts 140 facing out the first opening 128. A disk shaped moveable contact 146 is then slid into the a holding slot formed by the posts 140. The moveable contact 146 extends beyond the contact holder 136 as shown in FIGS. 5 & 6.

The switch 16 is assembled by passing the first shank portions 105 of the short terminals 102 and the second shank portions 108 of the long fixed terminals 104 through the open end of the housing 90 and through a group of a predetermined number of the slots 96 formed in the base portion 92. The free terminal ends of the first and second shank portions 105, 108 are thus positioned outside the housing 90 and the first and second contact portions 106, 110 are positioned within the housing 90 defining a circular path. The subassembly of the actuator 112 and the disk like moveable contact 146 is positioned in the housing 90 with the moveable contact 146 bearing against one of the contact portions 106, 110 of the short or long fixed terminals 102, 104 or bearing against adjacent contact portions 106, 110. The post portion 134 of the contact holder 136 is positioned and rotatable within the blind aperture 100 of the housing 90 base portion 92. In this position, the moveable contact 146 is rather loosely held and may rotate within the confines of the contact holder 136.

The subassembly of the lock 12, top plate 14, mid-plate 15 and retainer ring 86 is assembled with the subassembly of the switch 16 and actuator 112 by passing the tubular engagement portion 118 into the tubular element 76 of the mid-plate 15; engaging the shaft 28 of the lock cylinder 18 within the opening 120 of the tubular engagement portion 118 bringing the free edge of the engagement wall 122 into abutting relation with the mid-surface 67 of the mid-plate 15. The engagement wall 122 is circumscribed by the support wall 72. These two portions are then ultrasonically welded together completing the assembly. If desired other joining techniques such as adhesive bonding may be utilized. The triangular shaped element 25 has its apex engaged in one of the V shaped notches 47. This engagement will prevent accidental rotation of the lock cylinder 18 by bumping, for example, while permitting deliberate rotation by a key. The spring 144 is so dimensioned that its engagement with the contact holder 136 is loose until the assembly of the contact holder 136 and the moveable contact is positioned within the housing 90 and butted against the terminals 102, 104. This engagement applies a compressive force on the spring 144. As stated hereinbefore, the inventor's switchlock may be mounted on a cable TV system control box which is electrically interposed between the cable TV system and the home viewing system. A parent can, therefore, monitor use of the cable system with the switch lock key, and if a parent does not want a child to view a program on the cable system he need only remove and retain the key. The switch 16 is operated when an individual turns the key 50 that has been properly inserted in the lock 12. The key 50 rotates the lock cylinder 18 which, in turn, rotates the integral shaft 28 thereof. The stop portion 26 of the lock cylinder 18 is thereby moved within the arced recess defined by the first shoulder 38, the second shoulder 44, the secondary first circumferential surface 40 and the secondary second circumferential surfaces 46 of the shell 20 and simultaneously, the tubular engagement portion 118 of the actuator 112 is rotated through its engagement with the D shaped terminal end of the integral shaft 28 thus rotating the subassembly of the actuator 112 and the associated moveable contact 146. The first and second shoulders 38, 44 of the shell 20 provides the stop means; thereby, determining the degree of rotation of the integral shaft 28 and the stop portion 26. The moveable contact 146 will, for example, roll over either a first contact portion 105 or a second contact portion 110 and come to rest in the space between a first contact portion 105 and a second contact portion 110 making electrical contact between these two adjacent terminals.

Figure 9:
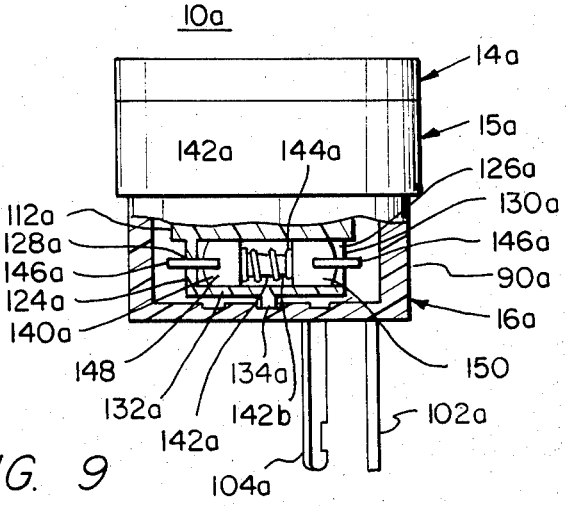
FIG. 9 is a side elevational view of the switch, partly broken away, of a variation of the switch lock shown in FIG. 1

There is shown in the drawings at FIG. 9 a variation **10*a* of the switch lock 10. The switch lock 10*a* comprises a lock (not shown), a top plate 14*a*, a mid-plate 15*a* and a switch 16*a*. The lock, the top plate 14*a*, and the mid-plate 15*a* are similar in all respects to the lock 12, the top plate 14 and the mid-plate 15. The variation occurs in the switch 16*a* which is a double throw configuration rather than the single throw configuration of the switch 16. The switch 16*a* is similar to the switch 16. The switch 16*a* has a housing 90*a* which is the same design as the housing 90 including short fixed terminals 102*a* and long fixed terminals 104*a*. The short and long fixed terminals 102*a*, 104*a* is of the same configuration as the short and long fixed terminals 102, 104. The switch 16*a* also has an actuator 112*a* which is similar in all respects to the actuator 112 including a tubular engagement portion 118*a* and a contact assembly engagement portion 124*a*. The tubular contact assembly engagement portion 124*a* is similar in all respects to the contact assembly engagement portion 124. The switch 16*a* also includes a first contact holder 148 and a second contact holder 150. The first and second contact holders 148, 150 are similar in all respects to the holder 136 except the shafts 142*a*, 142*b* of the first and second contact holders 148, 150 are much shorter than the shaft 142. The contact assembly engagement portion 124*a* includes a channel 126*a* formed therethrough and in right angle relation to the longitudinal axis of the actuator 112*a*. The channel 126*a* has a rectangular first opening 128*a* on one side thereof and a rectangular, comparatively narrow, slot-like second opening 130*a* on the opposite side thereof. The contact assembly engagement portion 124*a* includes an integral circular base section 132*a* having a first side and a second side. The first side forms a wall of the channel 126*a* and the second side of the base section 132*a* has a post portion 134*a* extending from the center thereof. The first and second contact holders 148, 150 each comprise a rectangular base element 138*a*, 138*b* each having a rectangular post 140*a* extending from the corners of one side thereof, in integral right angle relation to the horizontal plane of the base element 138*a*, 138*b* and each of the shafts 142*a*, 142*b* extend from the center of the other side of their respective base element 138*a*, 138*b*, in integral right angle relation to the horizontal plane thereof. The rectangular posts 140*a* of the first contact holder 148 is passed through the first opening 128*a*** to bear against the inside surface of the wall having the second opening 130*a* and to in effect circumscribe the second opening 130*a*. A spring 144*a* is engaged around the shaft 142*a* prior to insertion of first contact holder 148 into the channel 126*a*. The second contact holder 150 is inserted into the channel 126*a* through the first opening 128*a* with the free terminal end of the shaft 142*b* engaged against the free terminal end of the shaft 142*a* positioning the spring 144*a* into circumscribing relation with the shaft 142*a* and positioning the posts 140*a* face out the first opening 128*a*. A disk shaped moveable contact 146*a* is then slid into each of the holding slots formed by the posts 140*a*. The moveable contact 146*a* extend beyond the first and second contact holders 148, 150 as shown in FIG. 9. The spring 144*a* is so dimensioned that its engagement with the contact holders 148, 150 is loose until the assembly of the contact holders 148, 150 with their respective the moveable contacts 146*a* and these contacts are butted against the terminals 102*a*, 104*a*. This engagement applies a compressive force on the spring 144*a*.

In the variation the key (not shown) similar to the key 50 rotates the lock cylinder (not shown) which, in turn, rotates the integral shaft thereof. The stop portion of the lock cylinder is thereby moved within the arced recess defined by the first shoulder, the second shoulder, the secondary first circumferential surface and the secondary second circumferential surfaces of the shell and simultaneously, the tubular engagement portion (not shown) of the actuator 112*a* is rotated through its engagement with the D shaped terminal end of the integral shaft 28*a* thus rotating the subassembly of the actuator 112*a* and the associated moveable contacts 146*a*. The first and second shoulders of the shell provides the stop means; thereby, determining the degree of rotation of the integral shaft and the stop portion. Similar in all respects to the switch lock 10. The moveable contacts 146*a* will each, for example, roll over either a first contact portion 105*a* or a second contact portion 110*a* and come to rest in the space between a first contact portion 105*a* and a second contact portion 110*a* making electrical contact between these two adjacent terminals.

What I claim is:

1. A lock actuated switch comprising a lock, a key, a midplate, and a switch, the lock including a lock cylinder and a shell, the lock cylinder having a body portion, the body portion having a flange extending therefrom and a stop portion extending therefrom and including a key hole and an activating means, the activating means extending from the lock cylinder, having a free terminal end and having a logitudinal axis, the key engageable in the key hole and adapted on movement to rotate the activating means, the midplate comprises a top surface, a mid-surface, a lower surface and a centrally located through aperture, the lower surface having a tubular element extending therefrom forming a continuation of the aperture and is coaxial therewith, an antistatic wall extends away from the lower surface, circumscribes the tubular element in spaced relation, in spaced from the periphery of the lower surface, has a bottom surface and extends beyond the horizontal plane of the lower surface, the shell having a wall defining a through, longitudinal bore having a recess formed therewith, the body portion fitted within the bore and the stop portion positioned within the recess, the switch includes a tubular engagement portion extending therefrom and an engagement wall defining a circular configuration, the tubular element circumscribing the engagement portion, the engagement wall circumscribing the tubular element and the antistantic wall circumscribing the engagement wall, the tubular element and the antistatic wall of the midplate associated with the lock and the switch and positioned between the lock and the switch, the midplate operationally engaged with the switch and the lock, the switch having an actuating means and the activating means engaging the actuating means whereby rotation of the key will actuate the switch and will move the stop portion within the recess.

2. A lock actuated switch as set forth in claim 1 wherein the switch includes an actuator, the actuator comprising an under surface and an over surface, the over surface having a tubular engagement portion extending axially therefrom which includes a terminal end having an opening formed therein and an engagement wall extending away from the over surface, the engagement portion included as part of an actuator means and the engagement wall defines a substantially circular configuration, circumscribes the tubular engagement portion in spaced relation and is adjacent the periphery of the over surface, a tubular contact assembly engagement portion extends from the under surface, the contact assembly engagement portion includes a channel formed therethrough in right angle relation to the longitudinal axis of the actuator, the channel having a first opening on one side thereof and having a contact holder positioned therein.

3. A lock actuated switch as set forth in claim 2 wherein the channel includes a comparatively narrow, slot-like second opening on the opposite side from the first opening, the contact assembly engagement portion has an integral circular base section having a first side and a second side, the first side forms a wall of the channel and the second side of the base section has a post portion extending from the center thereof, a contact holder comprising a base element having a post extending from the corners of one side thereof, in integral right angle relation to the horizontal plane of the base element and a shaft extending from the center of the other side of the base element, in integral right angle relation to the horizontal plane thereof, a spring is engaged around the shaft and the assembly of the contact holder and the spring positioned in the channel with the free terminal end of the shaft engaged against the second opening and the posts facing out the first opening.

4. A lock actuated switch as set forth in claim 3, wherein a disk shaped moveable contact is positioned in a holding slot formed by the posts, with a portion of the contact extending beyond the contact holder.

5. A lock actuated switch as set forth in claim 1 wherein the antistatic wall extends beyond the horizontal plane of the lower surface and defines a substantially circular configuration, circumscribing the aperture in spaced relation.

6. The lock actuated switch set forth in claim 1 wherein the top surface has a support wall extending upwardly therefrom and defining a substantially circular configuration, spaced from the aperture adjacent the periphery of the top surface, a key element extends from the inner surface of the support wall into the area defined thereby and toward the aperture.

7. A lock actuated switch as set forth in claim 1 wherein the switch is a rotary switch.

8. A lock actuated switch as set forth in claim 1 wherein the switch includes an actuator, the actuator comprising an under surface and an over surface, the over surface having a tubular engagement portion extending axial therefrom which includes a terminal end having a D shaped opening formed therein and an engagement wall extending away from the over surface, the engagement portion included as part of an actuator means.

9. A lock actuated switch comprising a lock, a key, a midplate, and a switch, the lock including a key hole and an activating means, the key engageable in the key hole and adapted on movement to rotate the activating means, the midplate comprises a top surface, a mid-surface a lower surface and a centrally located through aperture, the lower surface having a tubular element extending therefrom forming a continuation of the aperture and is coaxial therewith, an antistatic wall extends away from the lower surface, circumscribes the tubular element in spaced relation, is spaced from the periphery of the lower surface, has a bottom surface and extends beyond the horizontal plane of the lower surface, the tubular element and the antistatic wall of the midplate associated with the switch and positioned between the lock and the switch, the midplate associated with the switch and the lock, the switch having an actuating means and the activating means engaging the actuating means, the switch includes a tubular engagement portion extending therefrom and an engagement wall defining a circular configuration, the engagement wall circumscribes the engagement portion the tubular element circumscribing the engagement portion, and the engagement wall circumscribing the tubular element whereby rotation of the key will actuate the switch.

* * * * *